US007938070B2

(12) United States Patent
Shea

(10) Patent No.: US 7,938,070 B2
(45) Date of Patent: May 10, 2011

(54) PALLET AND PALLET SUPPORT THEREOF

(76) Inventor: Ming-Ho Shea, Hong Kong (HK)

( * ) Notice: Subject to any disclaimer, the term of this patent is extended or adjusted under 35 U.S.C. 154(b) by 523 days.

(21) Appl. No.: 12/050,237

(22) Filed: Mar. 18, 2008

(65) Prior Publication Data

US 2009/0211498 A1 Aug. 27, 2009

(30) Foreign Application Priority Data

Feb. 26, 2008 (TW) ..... 97203282 U

(51) Int. Cl.
*B65D 19/00* (2006.01)

(52) U.S. Cl. ..... 108/56.3

(58) Field of Classification Search ..... 108/51.11, 108/56.3, 56.1, 51.3, 57.29, 57.34, 145, 147.22, 108/4, 99, 116–120; 248/188.2, 188.4, 188.8, 248/346.01, 346.02, 346.05, 346.3, 346.4, 248/164, 439, 166, 918, 121; 312/208.1
See application file for complete search history.

(56) References Cited

U.S. PATENT DOCUMENTS

| | | | | | |
|---|---|---|---|---|---|
| 2,918,241 | A | * | 12/1959 | Maher | 108/56.1 |
| 3,277,847 | A | * | 10/1966 | Jensen | 108/56.1 |
| 3,438,342 | A | | 4/1969 | Woolworth et al. | |
| 3,685,461 | A | * | 8/1972 | Belcher | 108/57.25 |
| 4,128,253 | A | * | 12/1978 | Powers | 280/79.11 |
| 4,267,781 | A | * | 5/1981 | Powers | 108/56.1 |
| 4,760,802 | A | * | 8/1988 | Leong | 108/157.16 |
| 5,329,862 | A | * | 7/1994 | Breezer et al. | 108/55.5 |
| 5,379,974 | A | * | 1/1995 | Slay et al. | 248/161 |
| 5,649,492 | A | * | 7/1997 | Chin-Shu | 108/51.3 |
| 6,357,364 | B1 | | 3/2002 | Maloney et al. | |
| 6,418,862 | B1 | * | 7/2002 | Heil | 108/57.12 |
| 6,564,725 | B2 | * | 5/2003 | Hale | 108/57.25 |
| 6,609,688 | B1 | * | 8/2003 | Mazzella et al. | 248/188.8 |
| 6,983,570 | B2 | * | 1/2006 | Mead | 52/263 |
| 2003/0071187 | A1 | * | 4/2003 | Herren et al. | 248/638 |
| 2008/0105168 | A1 | * | 5/2008 | Lee | 108/56.1 |

FOREIGN PATENT DOCUMENTS

JP 3144582 * 9/2008

* cited by examiner

*Primary Examiner* — Janet M Wilkens
(74) *Attorney, Agent, or Firm* — Alan Kamrath; Kamrath & Associates PA

(57) ABSTRACT

A pallet includes a carrier and a plurality of pallet supports. Each pallet support includes: a cover member, a retaining board, a retaining wall, a cannular piece, and a base member. The retaining board includes a first hole; the cover member includes a second hole, and the base member includes a third hole. The retaining wall and the cannular piece are located on the base member. The retaining board is located above the retaining wall. The cannular piece is connected to the cover member by passing through the first hole. Thus, the carrier can be supported between the cover member and the retaining board. The retaining board and the retaining wall are both made of paper material.

20 Claims, 6 Drawing Sheets

PALLET AND PALLET SUPPORT THEREOF

BACKGROUND OF THE INVENTION

1. Field of the Invention

The present invention relates to a pallet and a pallet support thereof and, more particularly, to a pallet and a pallet support constructed of paper material.

2. Description of the Related Art

Pallets are commonly used as material-handling equipment for industrial usage, as they are able to carry objects easily and can be used with a forklift truck for mass transportation. Therefore, the pallet has become commonplace in material handling. Presently, pallets are commonly made from wooden materials, but it has many disadvantages. Pallets which are made from wooden material are heavy, are costly, and can deteriorate easily after the pallet base comes into contact with water.

There exist pallets or pallet support structures in the prior art. As an example, U.S. Pat. No. 3,438,342 has disclosed a pallet support formed of a high impact plastic and which includes an outer wall member and an inner wall member. The outer wall member includes an upper laterally rib-shaped extending structure to enhance the supporting strength. However, these materials are made of plastic, which make it difficult for the processes of recovery, recycle, and reuse and which has negative impacts on the preservation of the environment.

In order to comply with the trend of environmental conservation and to achieve cost reduction, paper pallet related products have been invented. As an example, U.S. Pat. No. 6,357,364 has disclosed a paper pallet which comprises a top pad and several long strip-shaped supporting blocks to be positioned under the top pad. The supporting blocks are of a honeycomb configuration arranged by paper boards. However, the supporting material is made from paper and therefore, cannot prevent the paper pallet from corroding after it comes in contact with water. Also, the long strip-shaped support block only allows the forks of the forklift truck to enter from a specific direction, and the design does not allow entry from every direction.

Thus, it is essential to present a pallet support which is cost effective, environmental friendly, and convenient and which resolves the problems that have not been dealt with in the prior art.

SUMMARY OF THE INVENTION

One object of the present invention is to provide a pallet and pallet supports which can achieve cost reduction.

Another object of the present invention is to provide a pallet and pallet supports which are environmental friendly, and yet another object of the present invention is to provide a pallet and pallet supports which can be used and stored conveniently.

In order to achieve the above objectives, the present invention provides a pallet and a pallet support. The pallet comprises a carrier and a plurality of pallet supports. Each pallet support further comprises: a cover member, a retaining board, a retaining wall, a cannular piece, and a base member. The retaining board comprises a first hole; the cover member comprises a second hole; and the base member comprises a third hole. The retaining wall and the cannular piece are both located on the base member; the retaining board is located above the retaining wall; and the cannular piece is connected to the cover member by passing through the first hole. Thus, the carrier can be supported between the cover member and the retaining board. The retaining board and the retaining wall are both made of paper material.

The innovative design of the present invention can be used in industrial environments.

DETAILED DESCRIPTION OF THE PREFERRED EMBODIMENTS

The advantages and innovative features of the invention will become more apparent from the following preferred embodiments.

Figure 1:
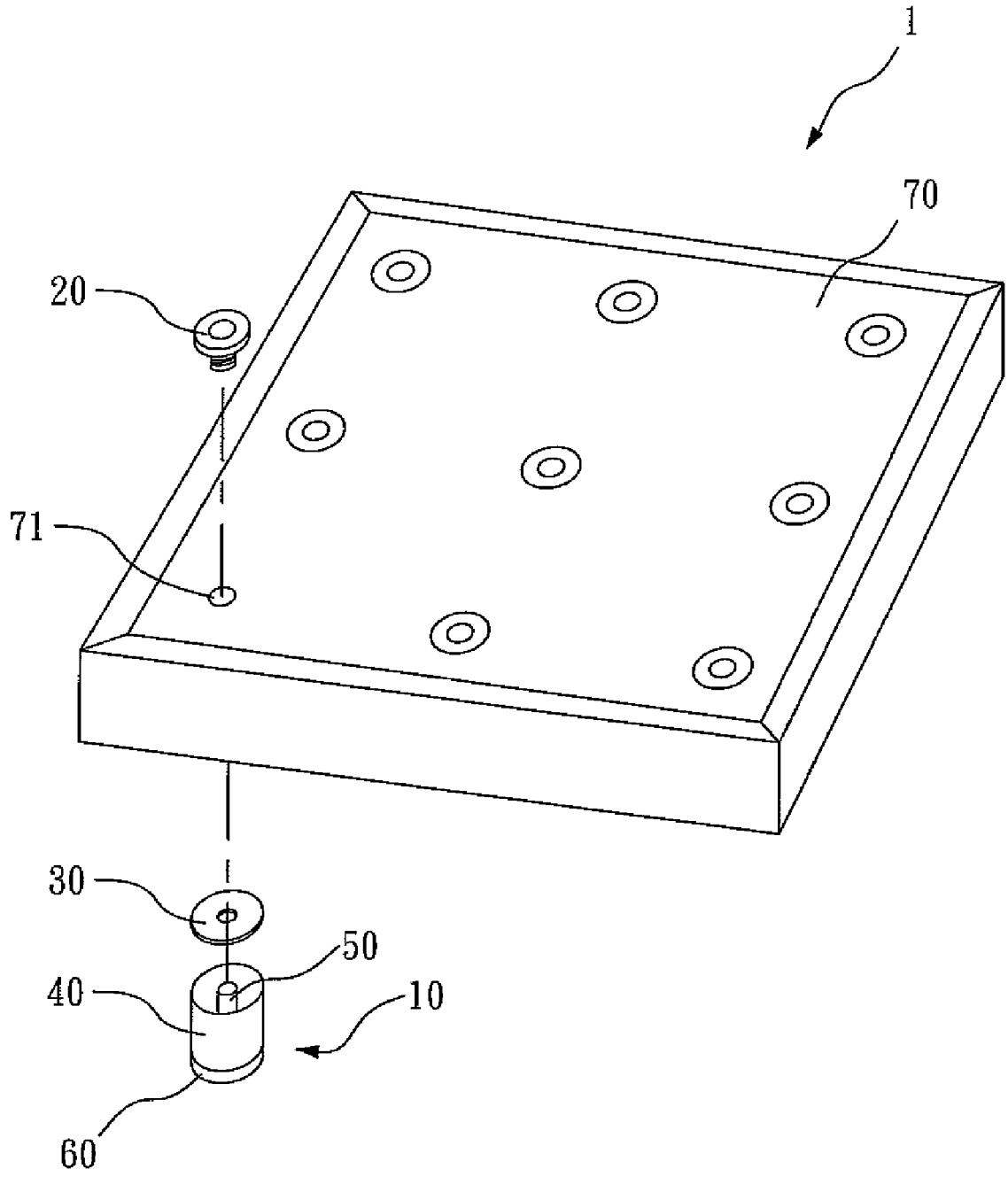
FIG. 1 is the structural diagram of a pallet for the present invention.

As shown in FIG. 1, a pallet 1 of the present invention comprises a carrier 70 and a plurality of pallet supports 10 which is used to support the carrier 70. In one embodiment of the present invention, the carrier 70 comprises a plurality of carrier holes 71. Each pallet support 10 is connected to the carrier 70 by passing through the plurality of carrier holes 71. Thus, the carrier 70 is supported by the plurality of pallet supports 10. The carrier 70 can withstand loadings after being supported, which can then be used for storage or transportation purposes.

In one embodiment, the plurality of pallet supports 10 can be attached to the carrier 70 using a separable connection method. Thus, the plurality of pallet supports 10 can be separated from the carrier 70 when the pallet is not in use, and it makes the process of storage or recycling of these parts more convenient.

The process of connection and separation between the plurality of pallet supports 71 and the carrier 70 will be described in more detail in the following section. In one embodiment, the carrier 70 is made by corrugated paper arranged in a honeycomb configuration. In the embodiment, the surface of the carrier 70 is also water-proofed. As an example, water-proof can be achieved by coating the carrier surface by a layer of waterproofed wax or water resistant material. However, the present invention is not limited to these materials.

Figure 2:
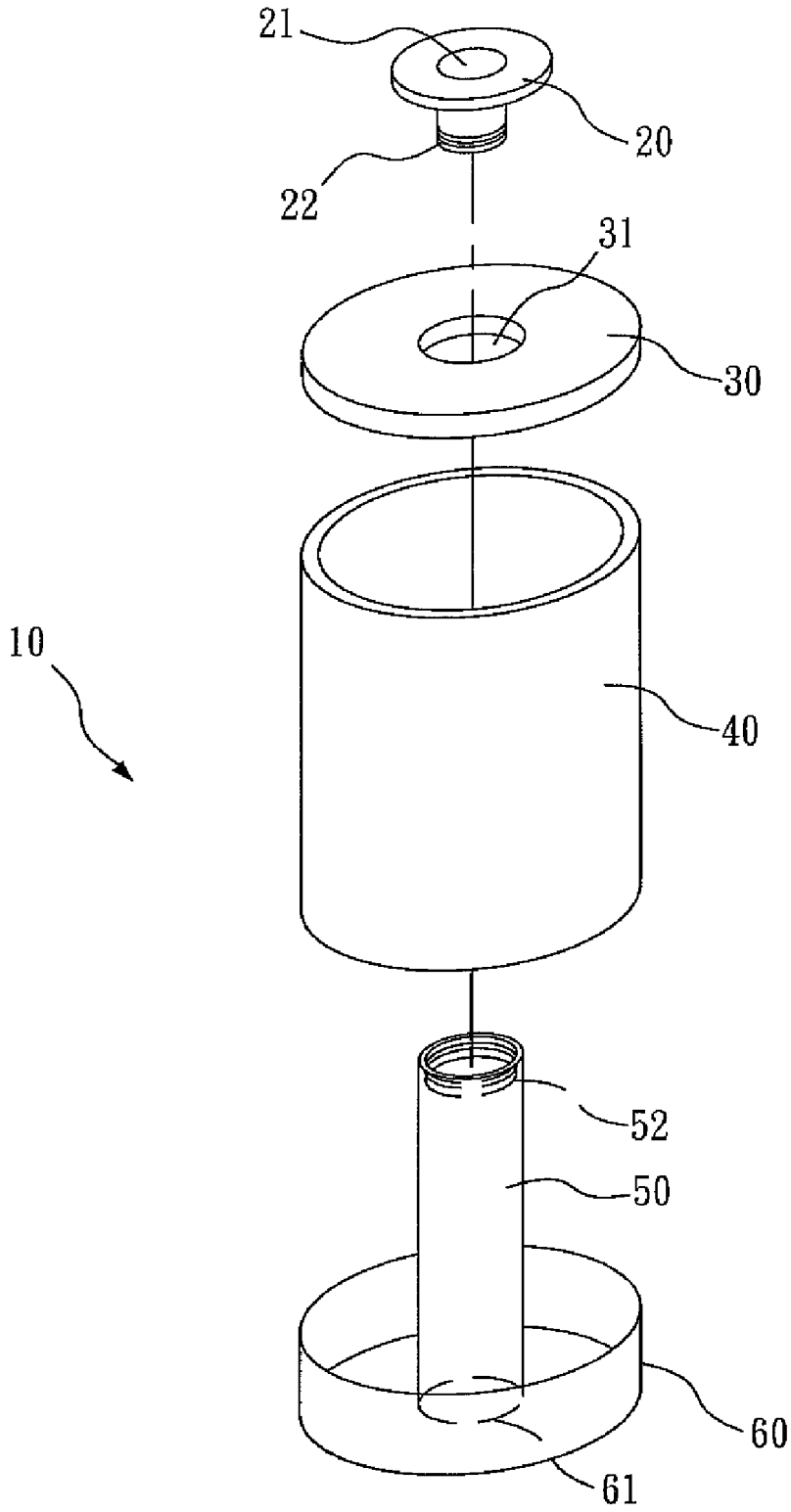
FIG. 2 is the disassembly diagram of the pallet support for the first embodiment in accordance with the present invention.

As depicted in FIG. 2, the present invention provides a pallet support 10 which can be used to support the carrier 70 as shown in FIG. 1. Pallet support 10 comprises a cover member 20, a retaining board 30, a retaining wall 40, a cannular piece 50 and a base member 60. The retaining board 30 comprises a first hole 31; the cover member 20 comprises a second hole 21; and the base member 60 comprises a third hole 61. The retaining wall 40 and the cannular piece 50 are both located on the base member 60; the retaining board 30 is located above the retaining wall 40; and the cannular piece 50 is connected to the cover member 20 by passing through the first hole 31. Thus, the carrier 70 can be supported between the cover member 20 and the retaining board 30.

In the first embodiment of the pallet support 10 for the present invention, the retaining board 30 and the retaining wall 40 are both made of paper material to reduce cost and to aid the recycling process. The retaining board 30 is circular-shaped, and the retaining wall 40 is cylindrical-shaped. However, the invention is not limited to that design. For example, in one embodiment of the present invention, the material of the retaining board 30 and the retaining wall 40 can be of plastic or other materials. The retaining board 30 can be square-shaped, and the retaining wall 40 can be a box-section tube.

In the first embodiment of the pallet support 10 for the present invention, the cover member 20, the cannular piece 50 and the base member 60 are made of plastic material, but the present invention is not limited to this material. The reason that plastic is used for the cover member 20, the cannular piece 50 and the base member 60 is that the connecting elements can be manufactured more easily with plastic materials (for example, the screwing or the clipping elements), and they are also water-proof. For example, whenever it rains or the pallet comes in contact with water, the water can reach the ground by flowing along the second hole 21 and the first hole 31, passing through the cannular piece 50 and, then, through the third hole 61. Thus, it will not have any effects on the retaining board 30 and the retaining wall 40. Furthermore, the base member 60 is made of plastic material. Thus, it can protect the retaining wall 40 and prevent it from possible deterioration which may be caused by water.

In the first embodiment of the pallet support 10 for the present invention, the cannular piece 50 and the base member 60 are constructed together as one component. The cover member 20 comprises a thread 22, and the cannular piece 50 comprises a groove 52. Thus, the separable connection between the cover member 20 and the cannular piece 50 is achieved by screwing thread 22 into a groove 52. However, the present invention is not limited to this arrangement. For example, in one embodiment of the present invention, the cover member 20 can consist of the groove 52 and the cannular piece 50 can consist of the thread 22. Thus, the separable connection between the cover member 20 and the cannular piece 50 can still be achieved. Furthermore, the length of the thread 22 and the groove 52 of pallet support 10 can be designed accordingly to cater for different thicknesses of the carrier 70.

Figure 3:
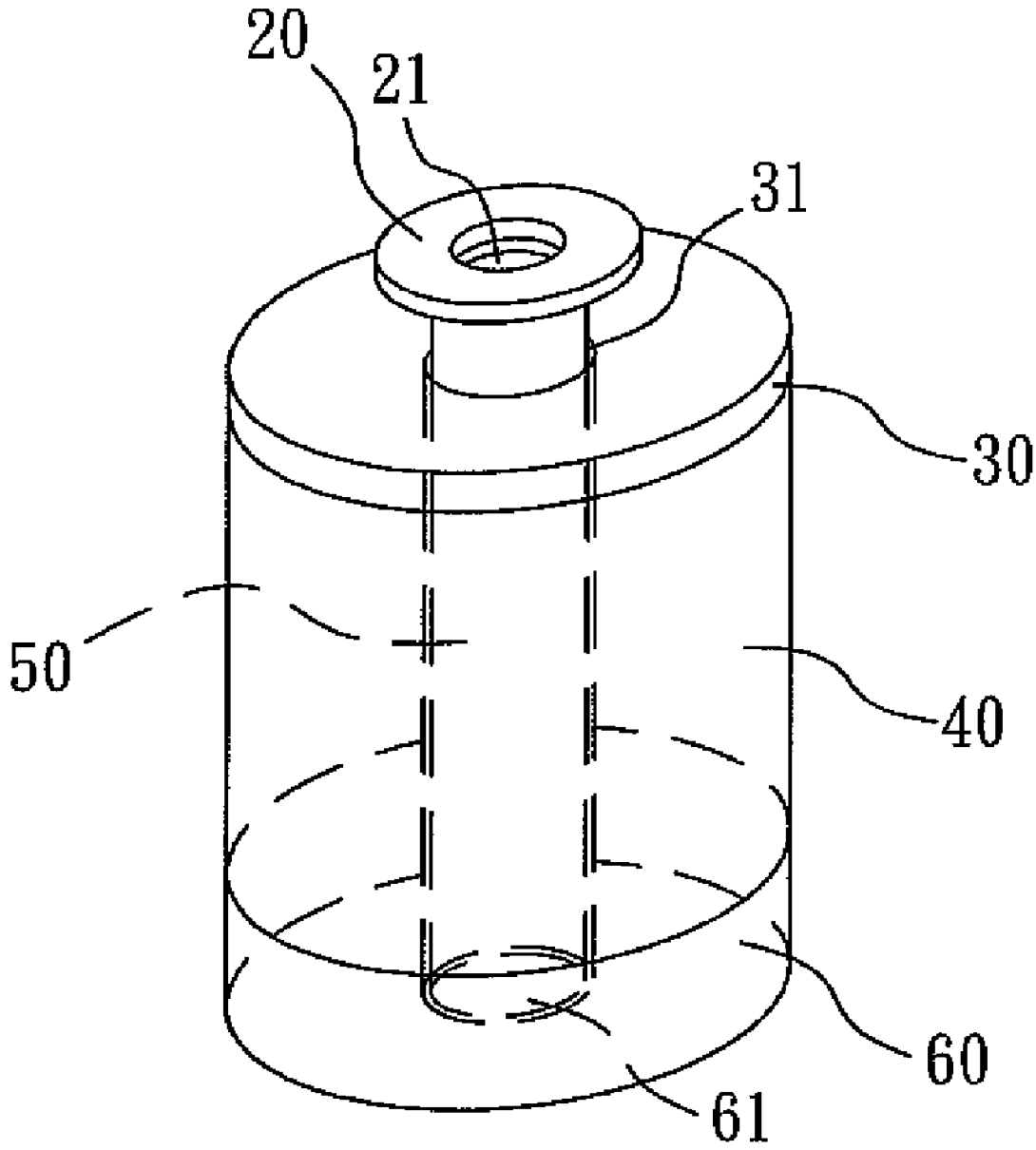
FIG. 3 is the assembly diagram of the pallet support for the first embodiment in accordance with the present invention.

In the first embodiment of the pallet support 10 for the present invention as shown in FIG. 3, the pallet support 10 is assembled by mounting the retaining wall 40 on top of the base member 60. The retaining board 30 is placed on top of the retaining wall 40, and the cannular piece 50 penetrates through the first hole 31. The cover member 20 is then connected to the cannular piece 50 by a groove and thread fastening technique.

Figure 4:
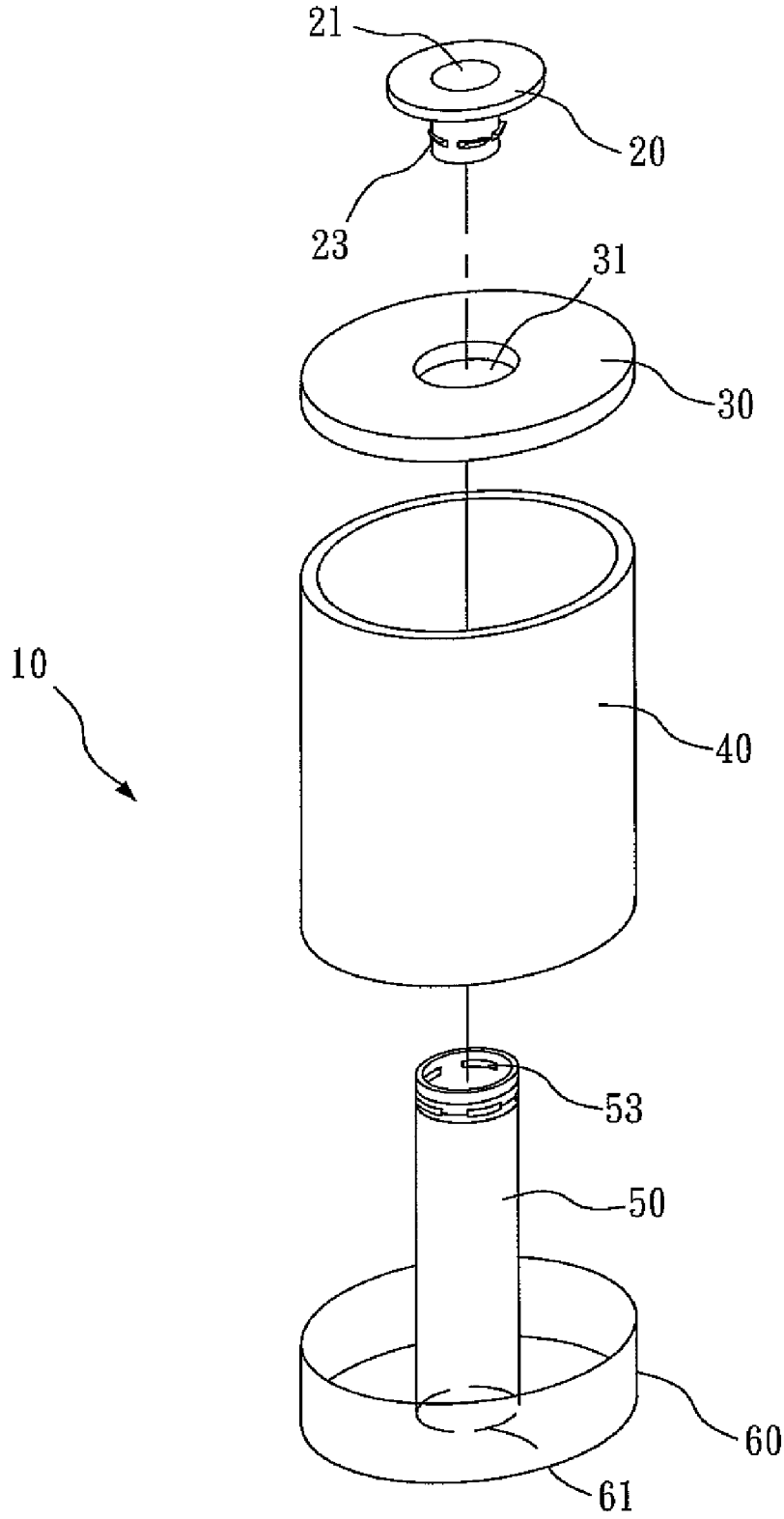
FIG. 4 is the disassembly diagram of the pallet support for the second embodiment in accordance with the present invention.

Refer to FIG. 4 for the second embodiment of the pallet support in accordance with the present invention. The main difference of this embodiment from the first embodiment is in the connection method which holds together the cover member 20 and the cannular piece 50. As shown in FIG. 4, the cover member 20 comprises a plurality of protruding elements 23, and the cannular piece 50 comprises a plurality of indentations 53. The separable connection between the cover member 20 and the cannular piece 50 can be achieved by clipping a plurality of protruding elements 23 with a plurality of indentations 53. However, the present invention is not limited to this method. For example, in one embodiment of the present invention, the cover member 20 can consist of multiple indentations 53, and the cannular piece 50 can consist of a plurality of protruding elements 23. Thus, separable connection can still be achieved between the cover member 20 and the cannular piece 50 through a snap-together fastening clip.

Figure 5:
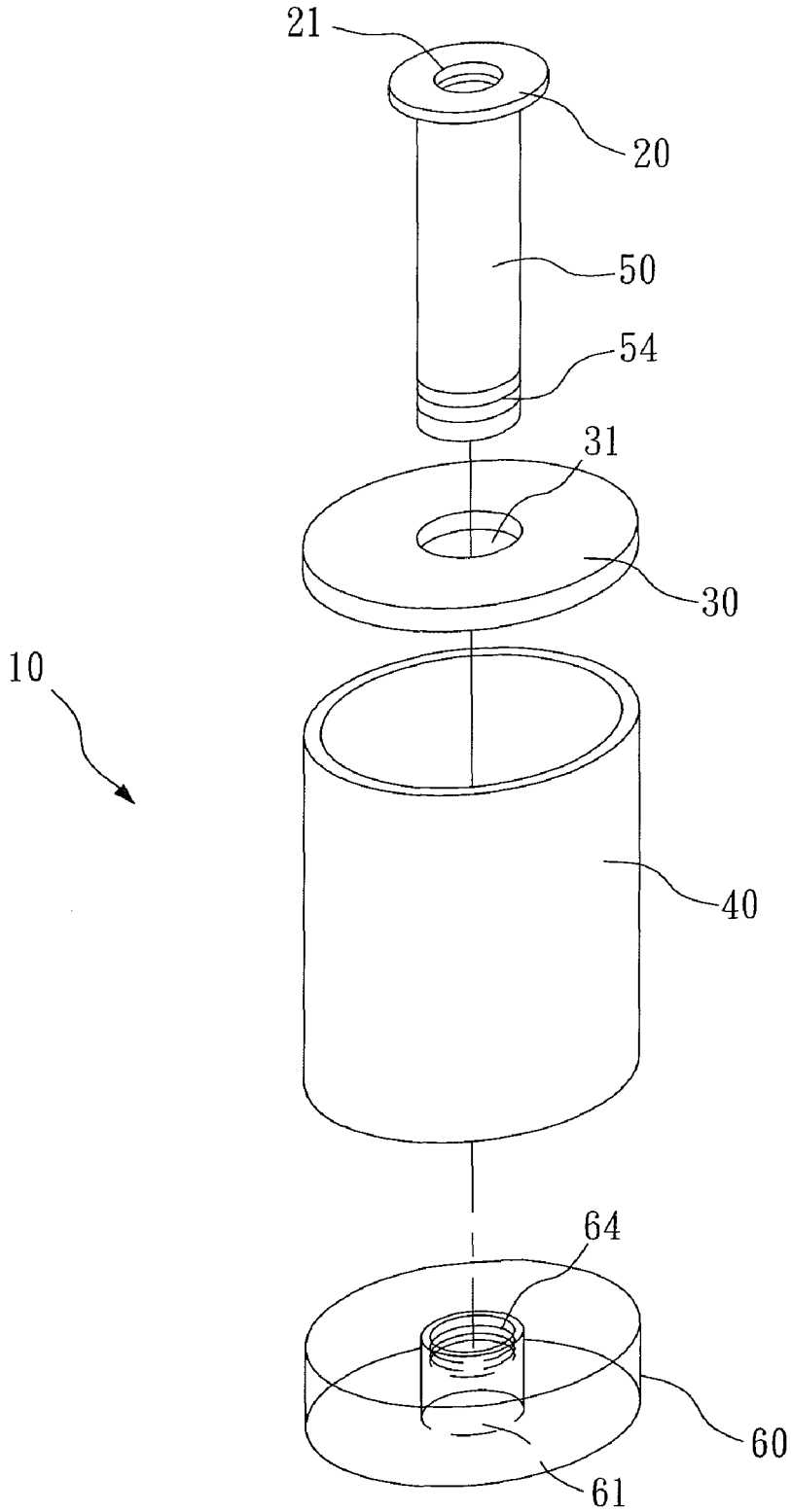
FIG. 5 is the disassembly diagram of the pallet support for the third embodiment in accordance with the present invention.

Refer to FIG. 5 for the third embodiment of the pallet support 10 in accordance with the present invention. The main difference of this embodiment from the first and the second embodiment lies within the construction of the cover member 20 and the cannular piece 50, as they are constructed as one component rather than two individual components. As shown in FIG. 5, the cannular piece 50 comprises a thread 54, and the base member 60 comprises a groove 64. Separable connection between the cannular piece 50 and the base member 60 is achieved by screwing the thread 54 into the groove 64. However, the present invention is not limited to this formation. As an example, in one embodiment of the present invention, the cannular piece 50 can have the groove 64, and the base member 60 can have the thread 54. Thus, separable connection between the cannular piece 50 and the base member 60 can be achieved by the groove and thread fastening method. Moreover, the length of the thread 54 and the groove 64 of the pallet support 10 can be designed accordingly to cater for different thicknesses of the carrier 70.

Figure 6:
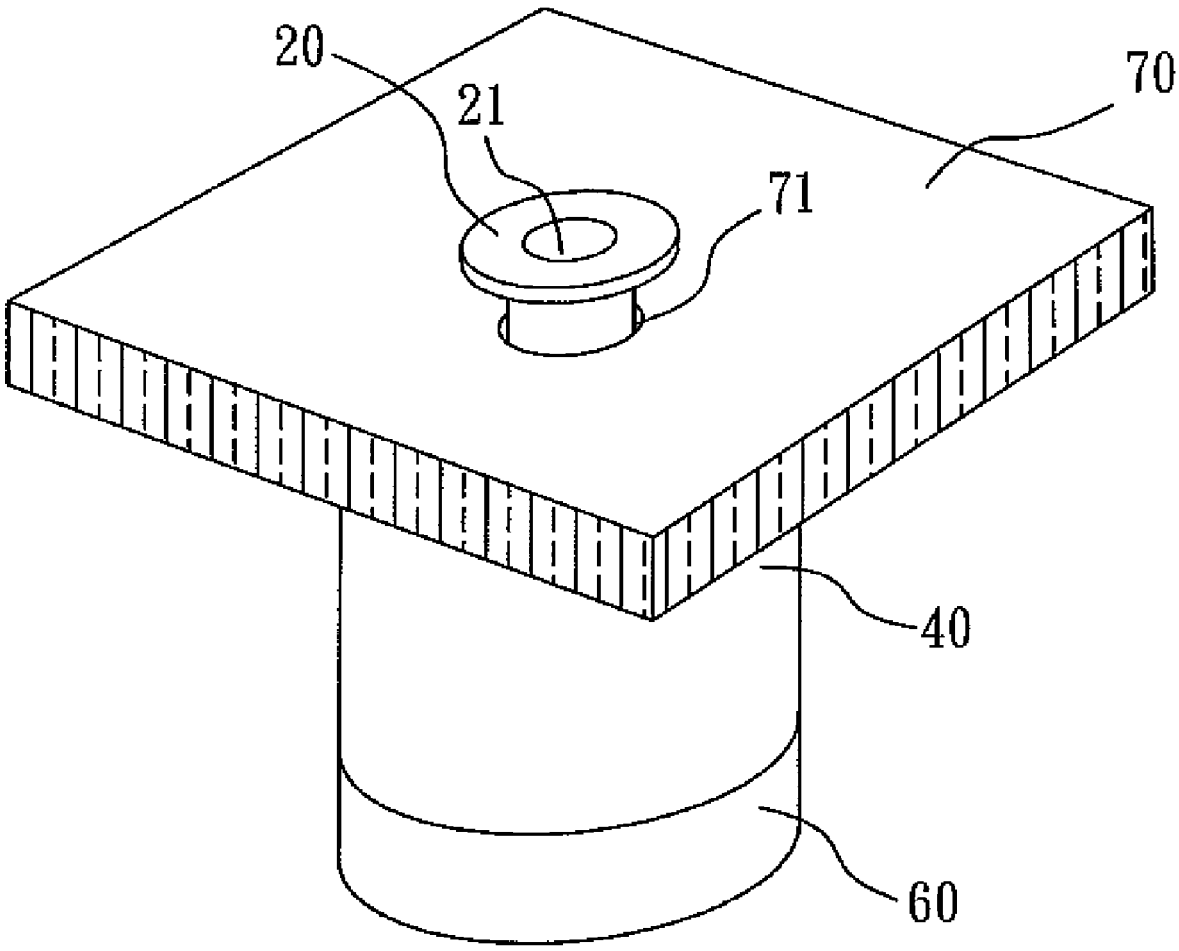
FIG. 6 is the assembly diagram of the pallet and the pallet support in accordance with the present invention.

Refer to FIG. 6 for an assembly diagram of the pallet support 10 and pallet 1 in accordance with the present invention. As shown in FIG. 6, a separable connection is used to connect a plurality of pallet supports 10 with the carrier 70, such that the carrier 70 is able to withstand loadings. The plurality of pallet supports 10 is connected to the carrier 70 through the following method: when the cannular piece 50 and the base member 60 are constructed as one component, each cannular piece 50 for the plurality of pallet supports 10 is used to penetrate through the carrier hole 71 of the carrier 70, such that the carrier 70 rests on the retaining board 30, and, then, the cover member 30 is connected with the cannular piece 50. If the cover member 20 and the cannular piece 50 are constructed as one component, the carrier 70 will be placed on the retaining board 30 of the pallet support 10, the cannular piece 50 will penetrate through the second hole 21 of the carrier 70 and then through the carrier hole 71, and the cannular piece 50 is connected to the base member 60.

Although the present invention has been explained in relation to its preferred embodiments, it is to be understood that many other possible modifications and variations can be made without departing from the spirit and scope of the invention as hereinafter claimed.

What is claimed is:

1. A pallet support used to support a carrier comprising:

a cover member;

a retaining board, wherein the retaining board comprises a first hole, wherein the retaining board is made of a paper material;

a retaining wall;

a cannular piece; and a base member, wherein the retaining wall and the cannular piece are both located on the base member, the retaining board is placed above the retaining wall, and the cannular piece is connected to the cover member by passing through the first hole, such that the carrier can be supported between the cover member and the retaining board.

2. The pallet support as claimed in claim 1, wherein the retaining wall is made of a paper material.

3. The pallet support as claimed in claim 1, wherein the cannular piece is constructed as one component with the base member.

4. The pallet support as claimed in claim 3, wherein the cannular piece is secured to the cover member through a separable connection method, which utilizes a groove and thread or snap-together clip fastening technique.

5. The pallet support as claimed in claim 1, wherein the cover member comprises a second hole, and wherein the second hole leads through to the first hole of the retaining board in an unobstructed manner.

6. The pallet support as claimed in claim 5, wherein the base member comprises a third hole, and wherein the third hole leads through to the first hole of the retaining board and to the second hole of the cover member in an unobstructed manner.

7. The pallet support as claimed in claim 1, wherein the retaining wall is cylindrically shaped.

8. The pallet support as claimed in claim 1, with the carrier comprising a plurality of carrier holes; with a plurality of the pallet supports used to support the carrier.

9. A pallet support used to support a carrier comprising:

a cover member;

a retaining board, wherein the retaining board comprises a first hole;

a retaining wall;

a cannular piece, wherein the cannular piece is constructed as one component with the cover member; and a base member, wherein the retaining wall and the cannular piece are both located on the base member, the retaining board is placed above the retaining wall, and the cannular piece is connected to the cover member by passing through the first hole, such that the carrier can be supported between the cover member and the retaining board.

10. The pallet support as claimed in claim 9, wherein the cannular piece is secured to the base member through a separable connection method, which utilizes a groove and thread or snap-together clip fastening technique.

11. A pallet support used to support a carrier comprising:

a cover member;

a retaining board, wherein the retaining board comprises a first hole;

a retaining wall;

a cannular piece; and a base member, wherein the retaining wall and the cannular piece are both located on the base member, the retaining board is placed above the retaining wall, and the cannular piece is connected to the cover member by passing through the first hole, such that the carrier can be supported between the cover member and the retaining board, wherein the cover member comprises a second hole, and wherein the second hole leads through to the first hole of the retaining board in an unobstructed manner.

12. The pallet support as claimed in claim 11, wherein the base member comprises a third hole, and wherein the third hole leads through to the first hole of the retaining board and to the second hole of the cover member in an unobstructed manner.

13. The pallet support as claimed in claim 11, wherein the retaining wall is cylindrically shaped.

14. The pallet support as claimed in claim 11, with the carrier comprising a plurality of carrier holes; with a plurality of the pallet supports-used to support the carrier.

15. The pallet support as claimed in claim 11, wherein the retaining wall is made of paper material.

16. The pallet support as claimed in claim 11, wherein the retaining board is made of paper material.

17. The pallet support as claimed in claim 11, wherein the cannular piece is constructed as one component with the base member.

18. The pallet support as claimed in claim 17, wherein the cannular piece is secured to the cover member through a separable connection method, which utilizes a groove and thread or snap-together clip fastening technique.

19. The pallet support as claimed in claim 11, wherein the cannular piece is constructed as one component with the cover member.

20. The pallet support as claimed in claim 19, wherein the cannular piece is secured to the base member through a separable connection method, which utilizes a groove and thread or snap-together clip fastening technique.

* * * * *